US009993067B2

(12) United States Patent
Lu

(10) Patent No.: US 9,993,067 B2
(45) Date of Patent: Jun. 12, 2018

(54) LENGTH-ADJUSTABLE FOOT SUPPORT FOR A TABLE AND SUPPORT BASE

(71) Applicant: FELLOWES, INC., Itasca, IL (US)

(72) Inventor: Scott Lu, Phoenix, AZ (US)

(73) Assignee: FELLOWES, INC., Itasca, IL (US)

( * ) Notice: Subject to any disclaimer, the term of this patent is extended or adjusted under 35 U.S.C. 154(b) by 59 days.

(21) Appl. No.: 15/221,349

(22) Filed: Jul. 27, 2016

(65) Prior Publication Data

US 2017/0251802 A1 Sep. 7, 2017

Related U.S. Application Data

(60) Provisional application No. 62/301,740, filed on Mar. 1, 2016.

(51) Int. Cl.

| | |
|---|---|
| ***A47B 1/00*** | (2006.01) |
| ***A47B 1/08*** | (2006.01) |
| ***A47B 9/20*** | (2006.01) |
| ***A47B 3/06*** | (2006.01) |

(52) U.S. Cl.

CPC ..... *A47B 1/08* (2013.01); *A47B 3/06* (2013.01); *A47B 9/20* (2013.01)

(58) Field of Classification Search

CPC .... A47B 1/08; A47B 1/10; A47B 9/20; A47B 13/02; A47B 17/02; A47B 17/03; A47B 21/02; A47B 21/03

See application file for complete search history.

(56) References Cited

U.S. PATENT DOCUMENTS

| | | | | |
|---|---|---|---|---|
| 2,805,776 | A * | 9/1957 | Levitin | A47F 7/30 211/207 |
| 3,082,712 | A * | 3/1963 | Johnson | A47B 13/02 108/158.11 |
| 3,769,919 | A * | 11/1973 | Thomas | A47B 1/08 108/102 |
| 3,912,210 | A * | 10/1975 | von Bohr | A47B 1/08 108/156 |
| 9,511,700 | B1 * | 12/2016 | Blackwell | B60N 3/001 |
| 2015/0282605 | A1 * | 10/2015 | Wu | A47B 3/002 248/188.2 |
| 2017/0238696 | A1 * | 8/2017 | Ehrreich | A47B 5/04 |
| 2017/0318958 | A1 * | 11/2017 | Asante | A47B 21/02 |

* cited by examiner

*Primary Examiner* — Daniel J Rohrhoff

(74) *Attorney, Agent, or Firm* — Gordon Rees Scully Mansukhani LLP; David R. Heckadon

(57) ABSTRACT

A length-adjustable foot support for a table and table support base having a housing with a longitudinal axis and an extension member that is movable along the longitudinal axis relative to the housing from a first position defining a first, shortest length of the length-adjustable foot support, to a second position defining a second length of the length-adjustable foot support that is longer than the first, shortest length.

12 Claims, 15 Drawing Sheets

LENGTH-ADJUSTABLE FOOT SUPPORT FOR A TABLE AND SUPPORT BASE

RELATED APPLICATION

The present application claims priority to U.S. Provisional Patent Application 62/301,740, of same title, filed Mar. 1, 2016, the entire disclosure of which is incorporated herein by reference in its entirety.

FIELD OF THE INVENTION

The present invention relates to a table generally, and more particularly to a length-adjustable foot support for use with a table and table support base.

BACKGROUND

Adjustable table bases are typically height-adjustable and/or width-adjustable to accommodate table work surfaces of different sizes and orientations. It is common in the industry to provide two different sizes, namely a "small" size for accommodating a table from approximately thirty-one inches to forty-seven inches wide, and a "large" size for accommodating a table from approximately forty-three inches to seventy-two inches wide.

It is also common in the industry to provide two different sets of feet, one "small" size that is approximately twenty-two inches long to accommodate a "small" size table having the above-noted width range, and a "large" size set of feet that is approximately twenty-eight inches long to accommodate a "large" size table having the above-noted width range. The larger the table, the larger the support structure and the larger the foot base.

Having multiple size table bases and feet is inefficient, especially if it is desired to provide an adjustable table base that can accommodate a large variety of table platform work surface sizes. There is a need, therefore, to provide a table base and adjustable foot structure that has the ability to accommodate a variety of table work surfaces having different sizes and configurations.

SUMMARY

A length-adjustable foot support for a table and table support base comprises a housing having a longitudinal axis and an extension member that is movable along the longitudinal axis relative to the housing from a first position defining a first, shortest length of the length-adjustable foot support, to a second position defining a second length of the length-adjustable foot support that is longer than the first, shortest length. Additional positions may define more than two lengths of the length-adjustable foot support. There is also provided a table and a table support base incorporating the length-adjustable foot support.

DETAILED DESCRIPTION OF THE PREFERRED EMBODIMENTS

Figure 1:
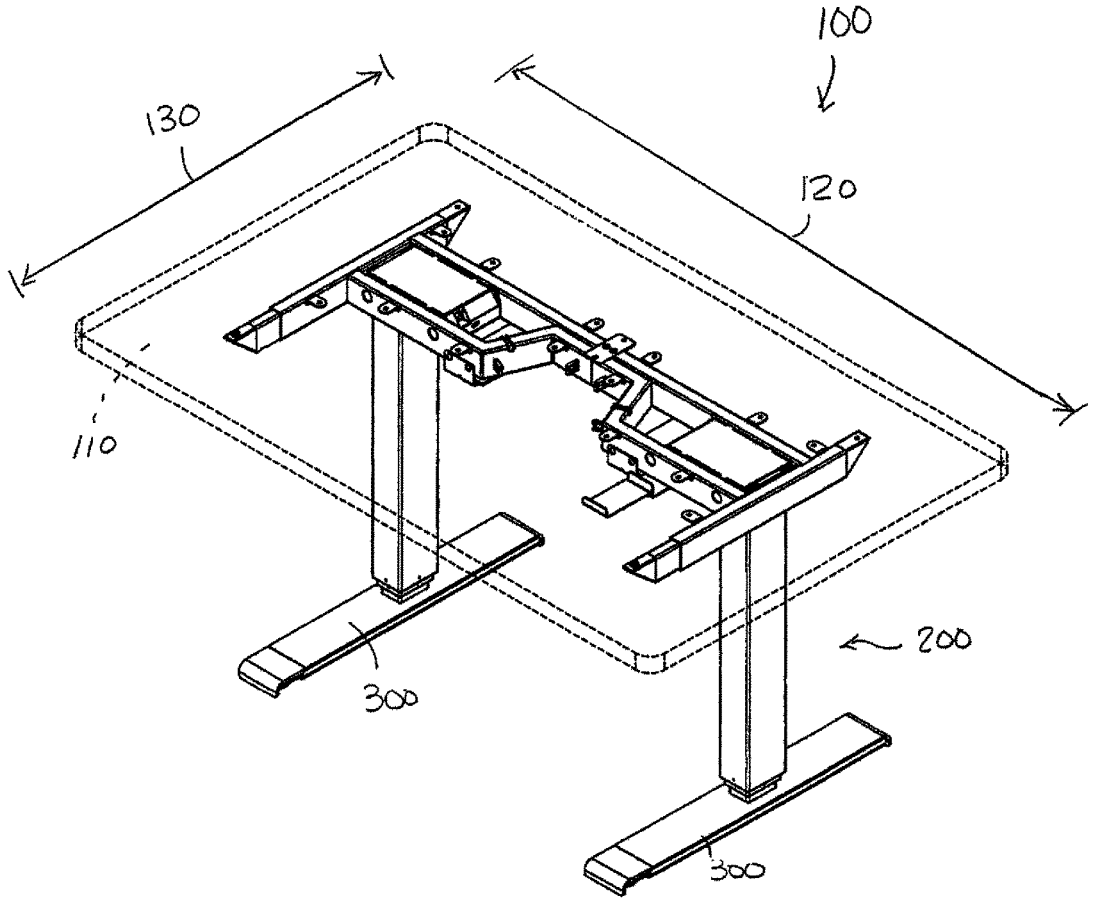
FIG. 1 is a perspective view of one embodiment of a table comprising one embodiment of a support base of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 is a perspective view of one embodiment of a table 100 comprising one embodiment of a support base 200 for supporting a work surface 110 having a width 120 and a depth 130. While the embodiment of FIG. 1 illustrates a generally rectangular work surface 110 having a certain size, shape and orientation relative to the support base 200, it will be appreciated that the present disclosure is not limited to the use of a work surface 110 of any particular size, shape or orientation. For purposes of convenience and explanation, a generally rectangular work surface 110 will be illustrated and described to assist with explaining various features and elements of the table 100 of the present disclosure. Further, while a work surface 110 is illustrated in FIG. 1, it will be appreciated that the work surface 110 may be optional and may be manufactured and/or vended separately from the support base 200. Again, for purposes of convenience, the table 100 will be described as comprising the work surface 110 and support base 200. Further, the scope of the present disclosure is not limited to the use of a work surface 110, but also applies to just the support base 200. Other variations are possible.

Figure 2:
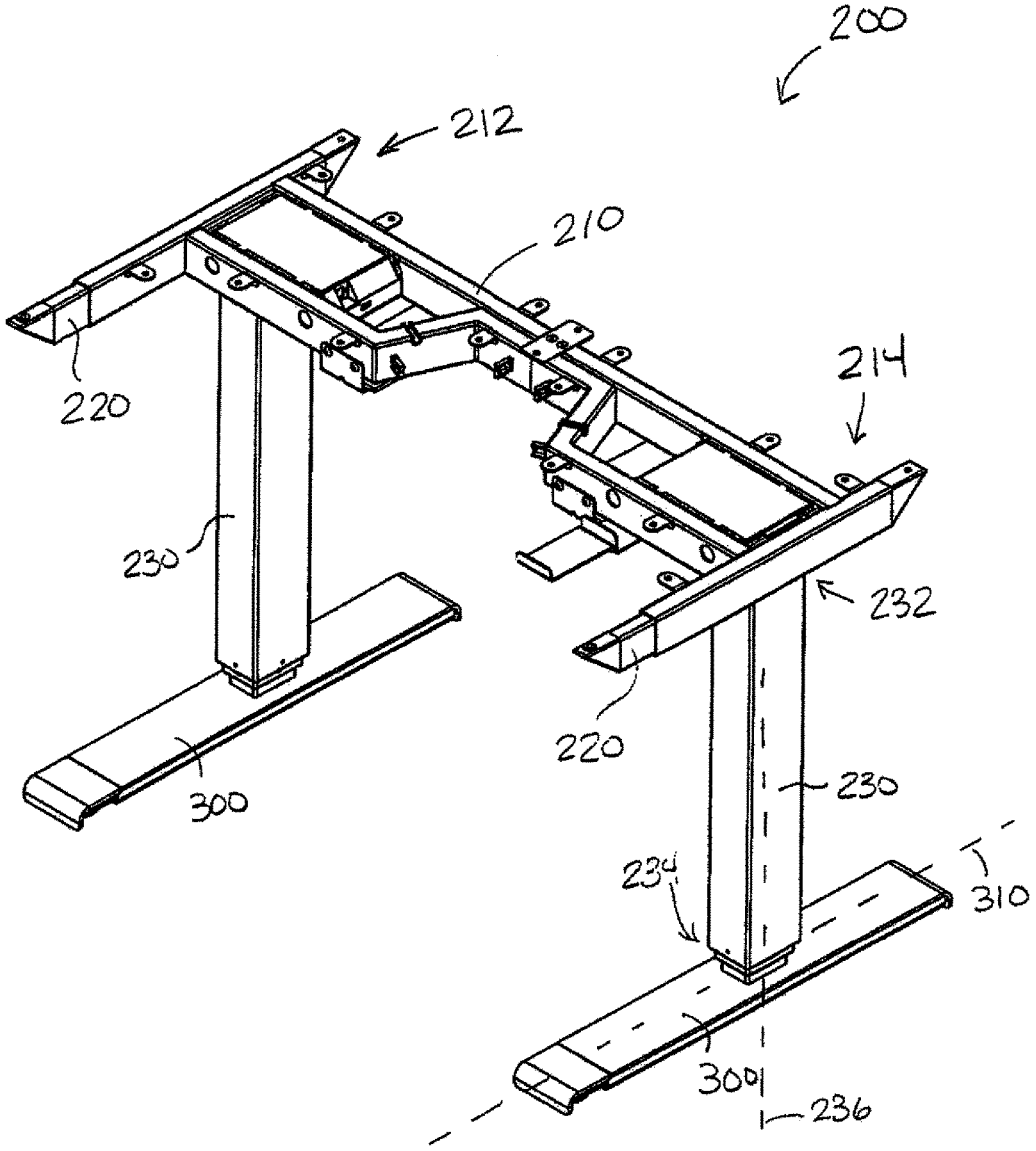
FIG. 2 is a perspective view of one embodiment of a support base of the present disclosure in a non-extended condition.
Figure 3:
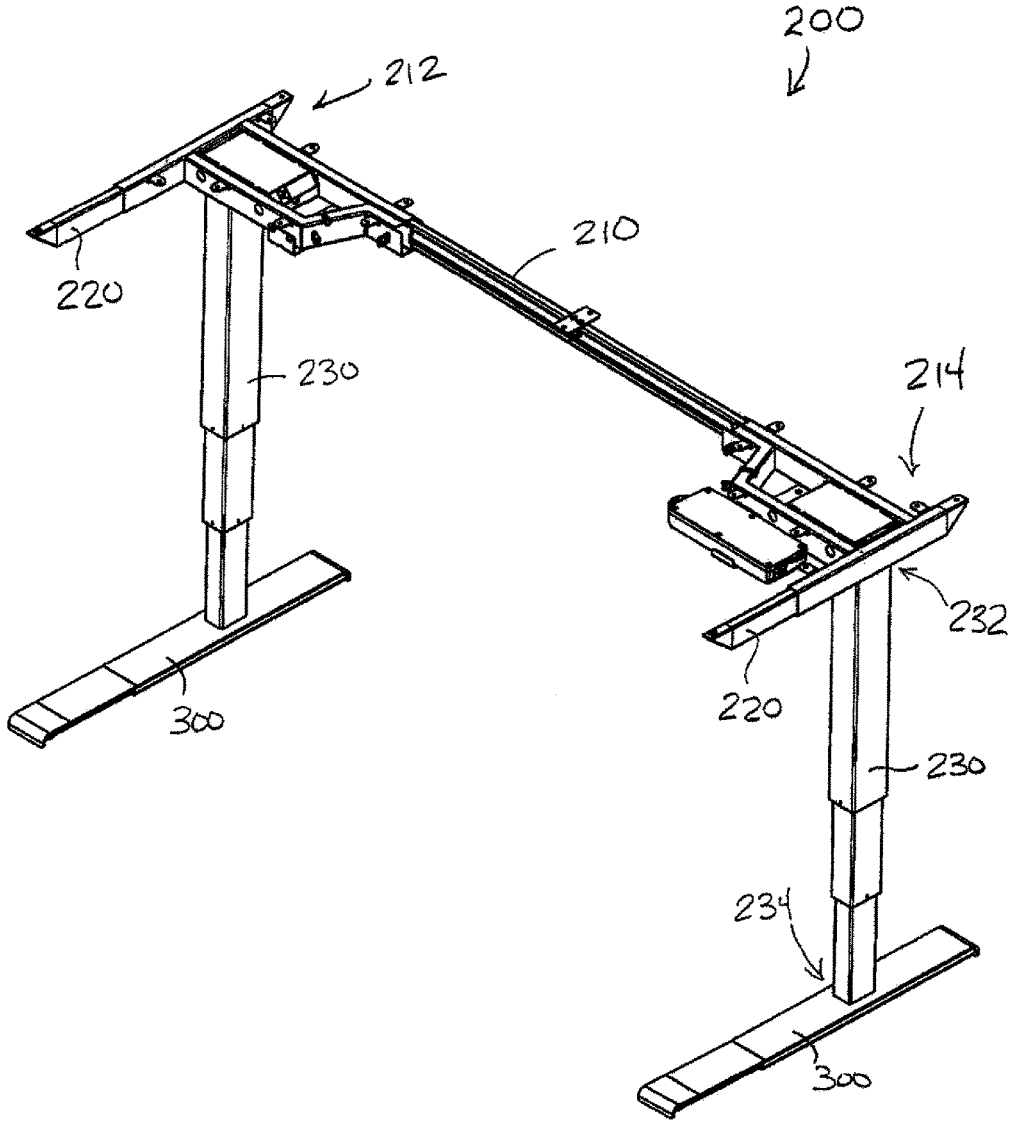
FIG. 3 is a perspective view of one embodiment of a support base of the present disclosure in an extended condition.

FIG. 2 and FIG. 3 are perspective views of one embodiment of a support base 200 incorporating the features and concepts of the present disclosure, shown without the work surface 110 to better illustrate the features and elements of the support base 200, with the support base 200 shown in a non-expanded condition in FIG. 2 and in a fully-expanded condition in FIG. 3. The embodiment of the support base 200 illustrated in FIGS. 2-3 further comprises a width-adjustable support 210 having a first end 212 and a second end 214 for supporting the width 120 of the work surface 110 (FIG. 1). In one embodiment, the width-adjustable support may be capable of manually and/or mechanically expanding the width of the support base 200 from a first width dimension (FIG. 2 for example) to a second width dimension (FIG. 3 for example) as desired by user requirements and to accommodate smaller or larger work surfaces, or for example in the case of certain standard table dimensions, from a first width dimension of approximately thirty-four inches in a non-expanded condition (FIG. 2) to a second width dimension of approximately sixty-four inches in a fully-expanded condition (FIG. 3), it being understood that such dimensions may be variable and certain particular dimensions are only described herein for purposes of explanation. In one embodiment, the width-adjustable support 210 may be manually-adjustable by simply pulling the first end 212 away from the second end 214, or in one embodiment through the use of a crank and worm gear (not shown) that causes the first and second ends 212, 214 to move relative to each other. In another embodiment, the width-adjustable support 210 may be power-adjustable through the use of an electrically-operated motorized system, or through a pneumatic system, or through other means that cause the first end 212 and the second end 214 to move relative to each other without manual operation by a user.

In addition to the width-adjustable support 210, there is also provided at least one depth-adjustable support 220 in the present embodiment that is disposed on either the first end 212 or the second end 214 of the width-adjustable support 210 for supporting the depth 130 of the work surface 110 (FIG. 1). In a preferred embodiment, there is provided a depth-adjustable support 220 disposed on each of the first end 212 and the second end 214 of the width-adjustable support 210. The depth-adjustable supports may be manually or mechanically extended from a first depth dimension (FIG. 2. for example) to a second depth dimension (FIG. 3 for example) as desired by user requirements and to accommodate smaller or larger work surfaces, or for example in the case of certain standard table dimensions, from a first depth dimension in a non-expanded condition (FIG. 2) of approximately nineteen inches to a second depth dimension in a fully-expanded condition (FIG. 3) of approximately twenty-four inches, or anywhere in between, it being understood that such dimensions may be variable and certain particular dimensions are only described herein for purposes of explanation. Additional depth-adjustable supports may be provided on the support base 200 depending on the configuration of the work surface 110, especially if the work surface is irregularly-shaped or of a certain structural configuration that would merit additional support.

The support base 200 further comprises at least one height-adjustable support 230 having an upper end 232 and a lower end 234 for adjusting the height of the support base 200 along a vertical axis 236. In a preferred embodiment, there is provided a height-adjustable support 230 disposed adjacent each of the first and second ends 212, 214 of the width-adjustable support 210 as illustrated in FIG. 2. The height-adjustable support 230 or leg may be manually or mechanically extended from a first height dimension (FIG. 2 for example) to a second height dimension (FIG. 3 for example) as desired by user requirements and to accommodate smaller or larger work surfaces, or for example in the case of certain standard table dimensions, from a first height dimension in a non-expanded condition (FIG. 2) of approximately twenty-three inches to a second height dimension in a fully-expanded condition (FIG. 3) of approximately fifty inches, or anywhere in between, it being understood that such dimensions may be variable and certain particular dimensions are only described herein for purposes of explanation.

The support base 200 further comprises at least one length-adjustable foot support 300 extending along a longitudinal axis 310 (FIG. 2) that is transverse to the vertical axis 236 of the at least one height-adjustable support 230 and that is attached to the lower end 234 of the at least one height-adjustable support 230. In a preferred embodiment, there is provided a pair of length-adjustable foot supports 300 attached to the lower ends 234 of a pair of height-adjustable supports 230 as illustrated in FIGS. 2 and 3. The length-adjustable foot support 300 may be extended along the longitudinal axis 310 from a first length dimension (FIG. 2 for example) to a second length dimension (FIG. 3 for example) as desired by user requirements and to accommodate smaller or larger work surfaces, or for example in the case of certain standard table dimensions, from a first length dimension in a non-expanded condition (FIG. 2) of approximately twenty-two inches to a second length dimension in a fully-expanded condition (FIG. 3) of approximately twenty-eight inches, or anywhere in between, it being understood that such dimensions may be variable and that certain particular dimensions are only described herein for purposes of explanation.

Figure 4A:
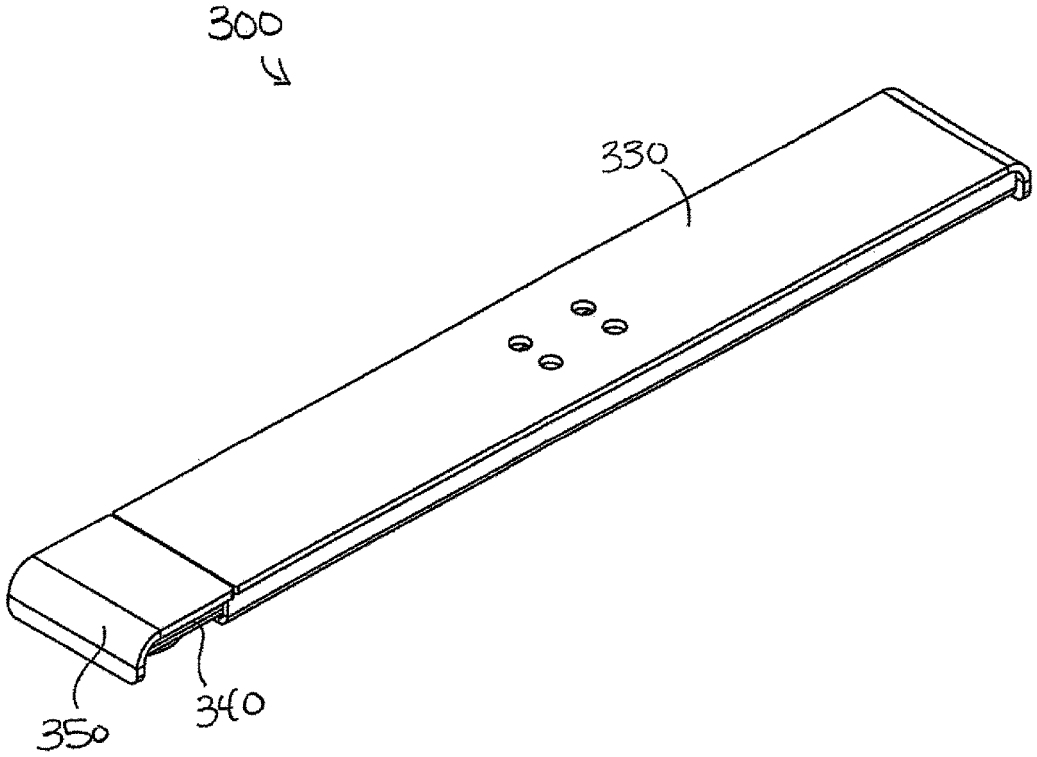
FIGS. 4A-4B illustrate a perspective view taken from the top and underside respectively of one embodiment of a length-adjustable foot support of the present disclosure in a non-extended, assembled condition.
Figure 4B:
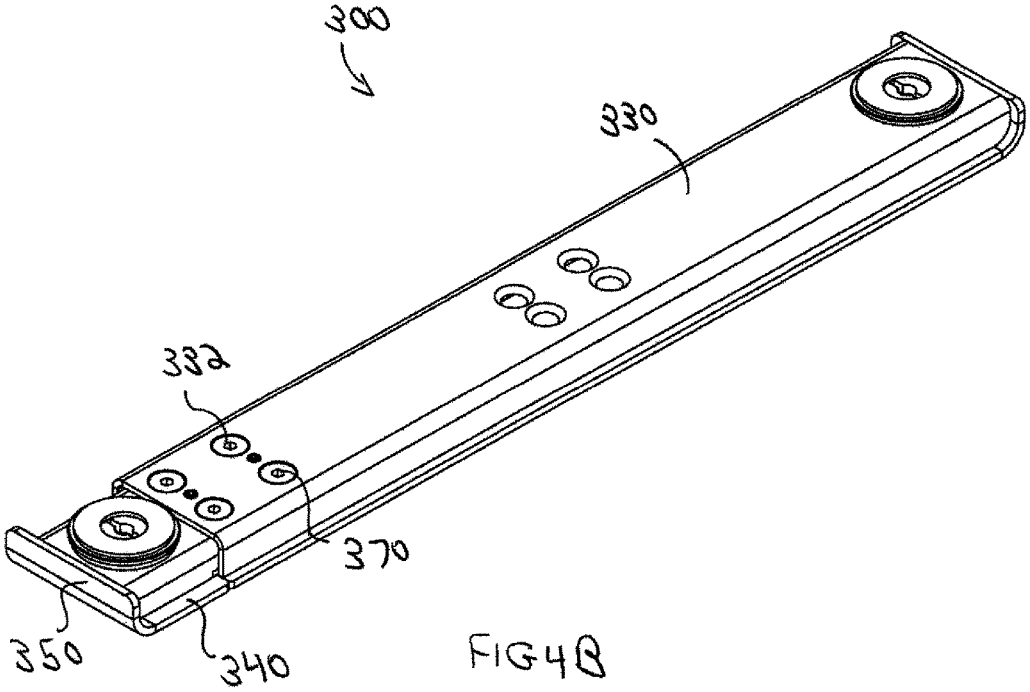
Figure 5A:
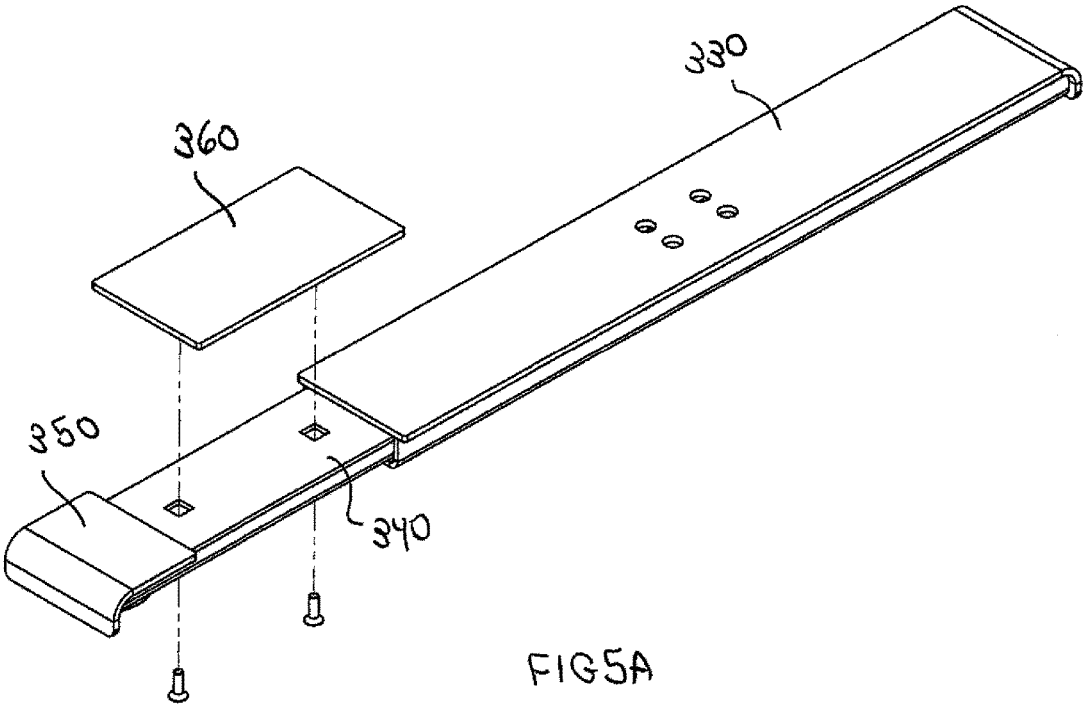
FIGS. 5A-5B illustrate an exploded view taken from the top and underside respectively of one embodiment of a length-adjustable foot support of the present disclosure in an extended condition.
Figure 5B:
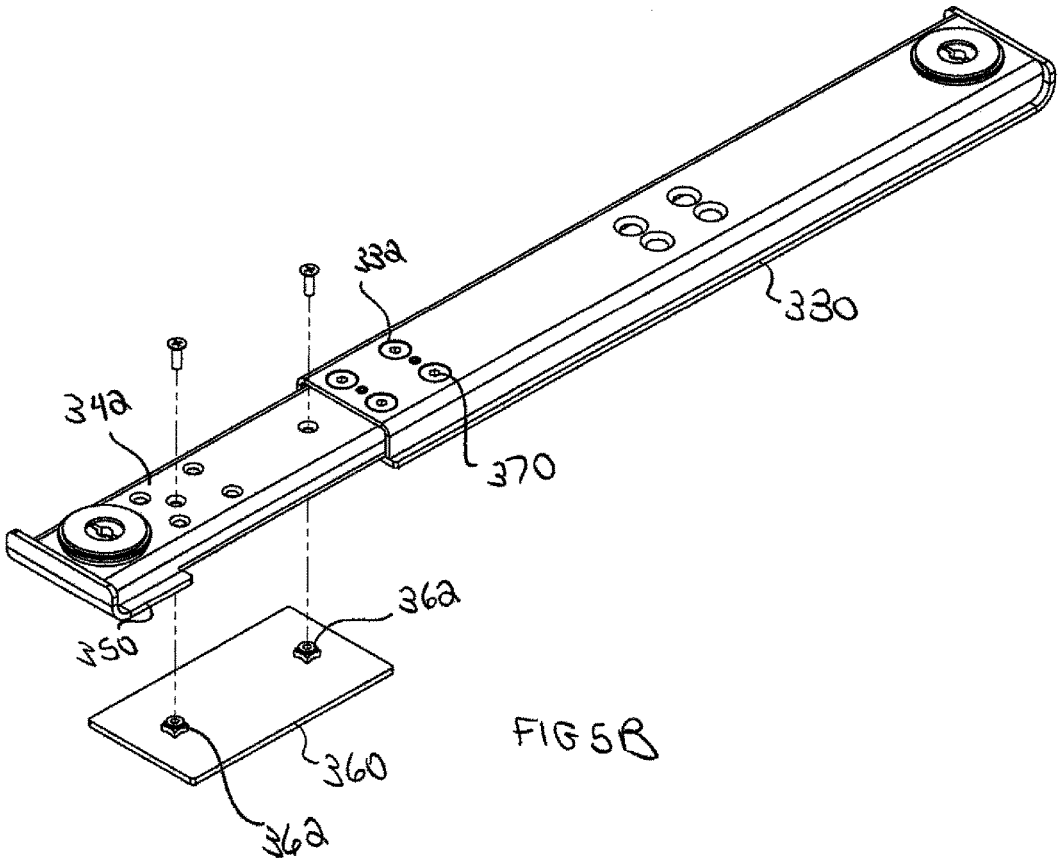
Figure 6A:
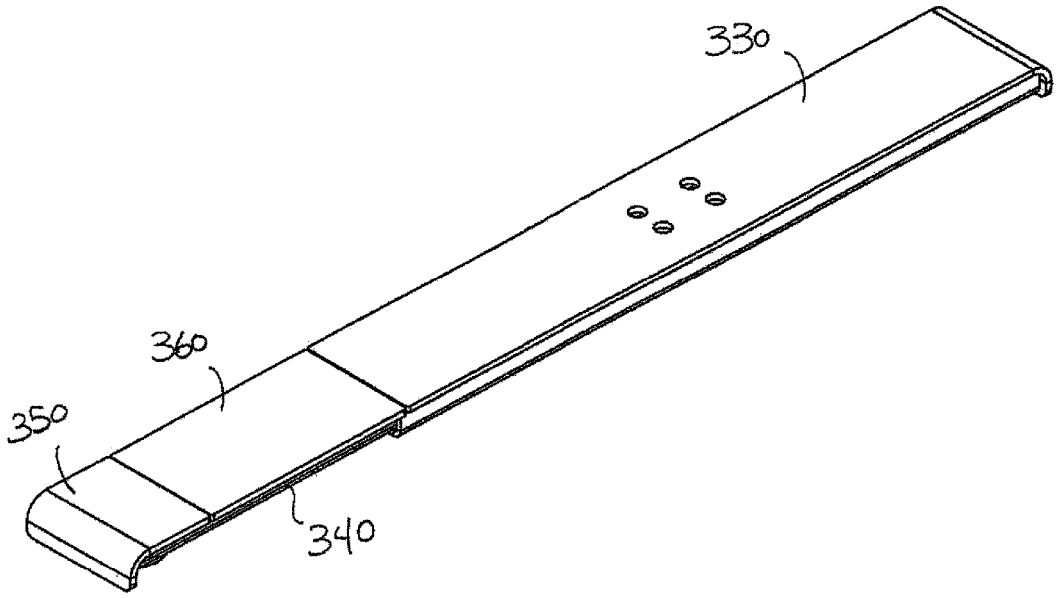
FIGS. 6A-6B illustrate a perspective view taken from the top and underside respectively of one embodiment of a length-adjustable foot support of the present disclosure in an extended and assembled condition.
Figure 6B:
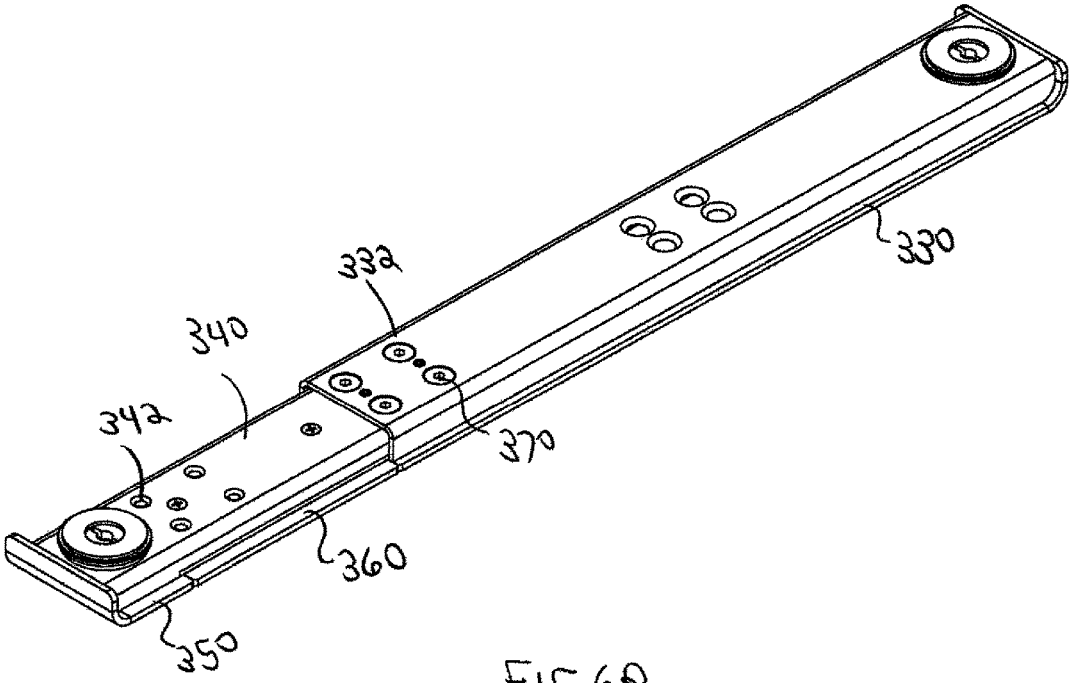
Figure 7A:
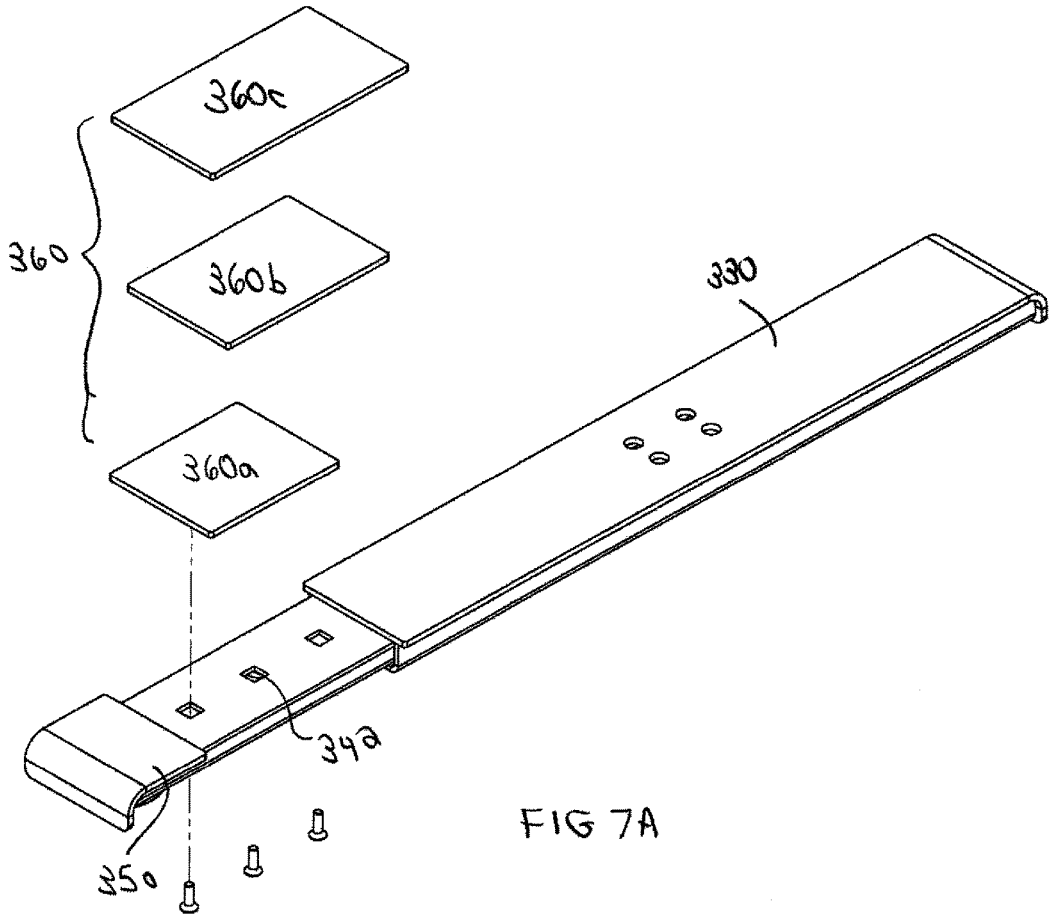
FIGS. 7A-7B illustrate a perspective view taken from the top and underside respectively of one embodiment of a length-adjustable foot support of the present disclosure in an extended condition.
Figure 7B:
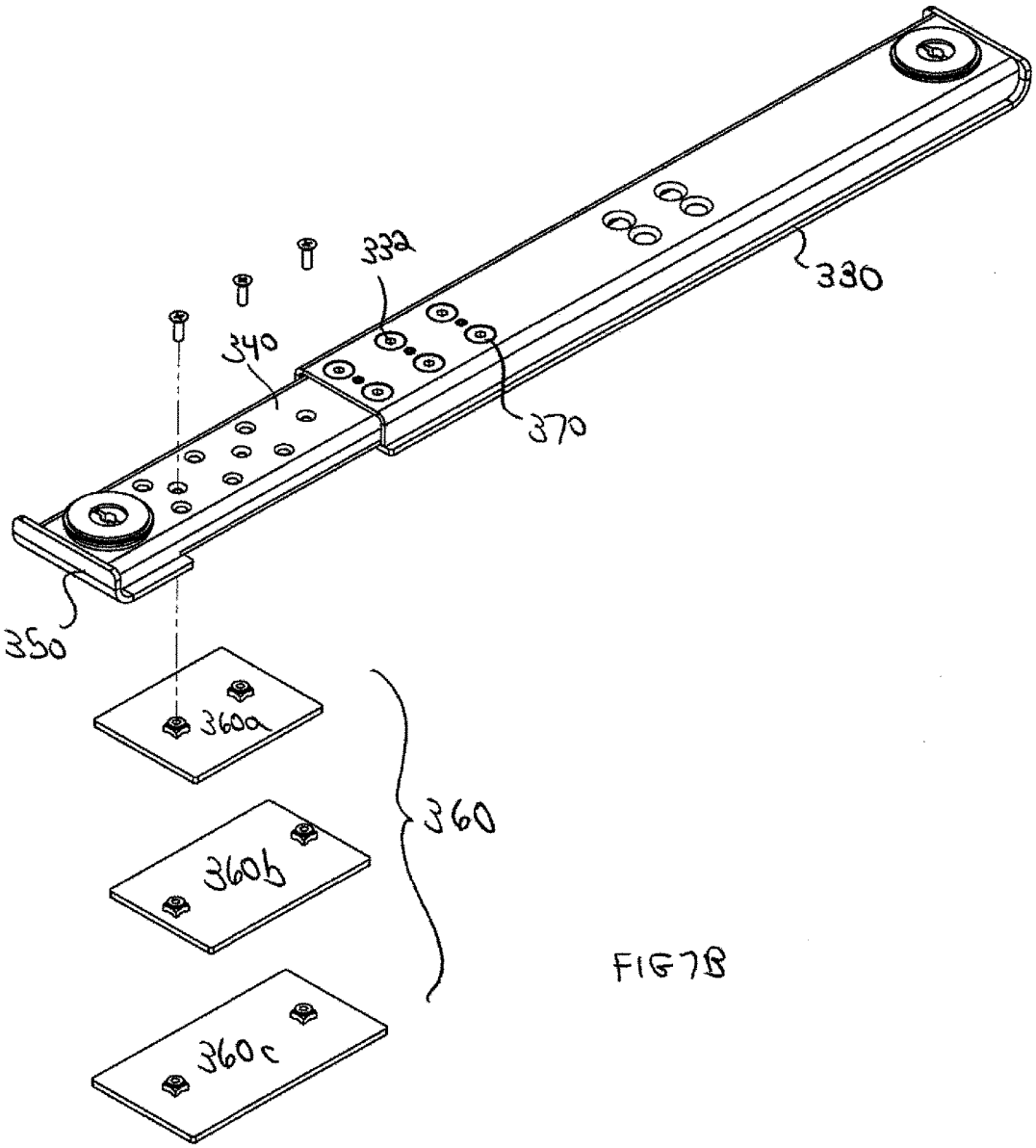
Figure 8A:
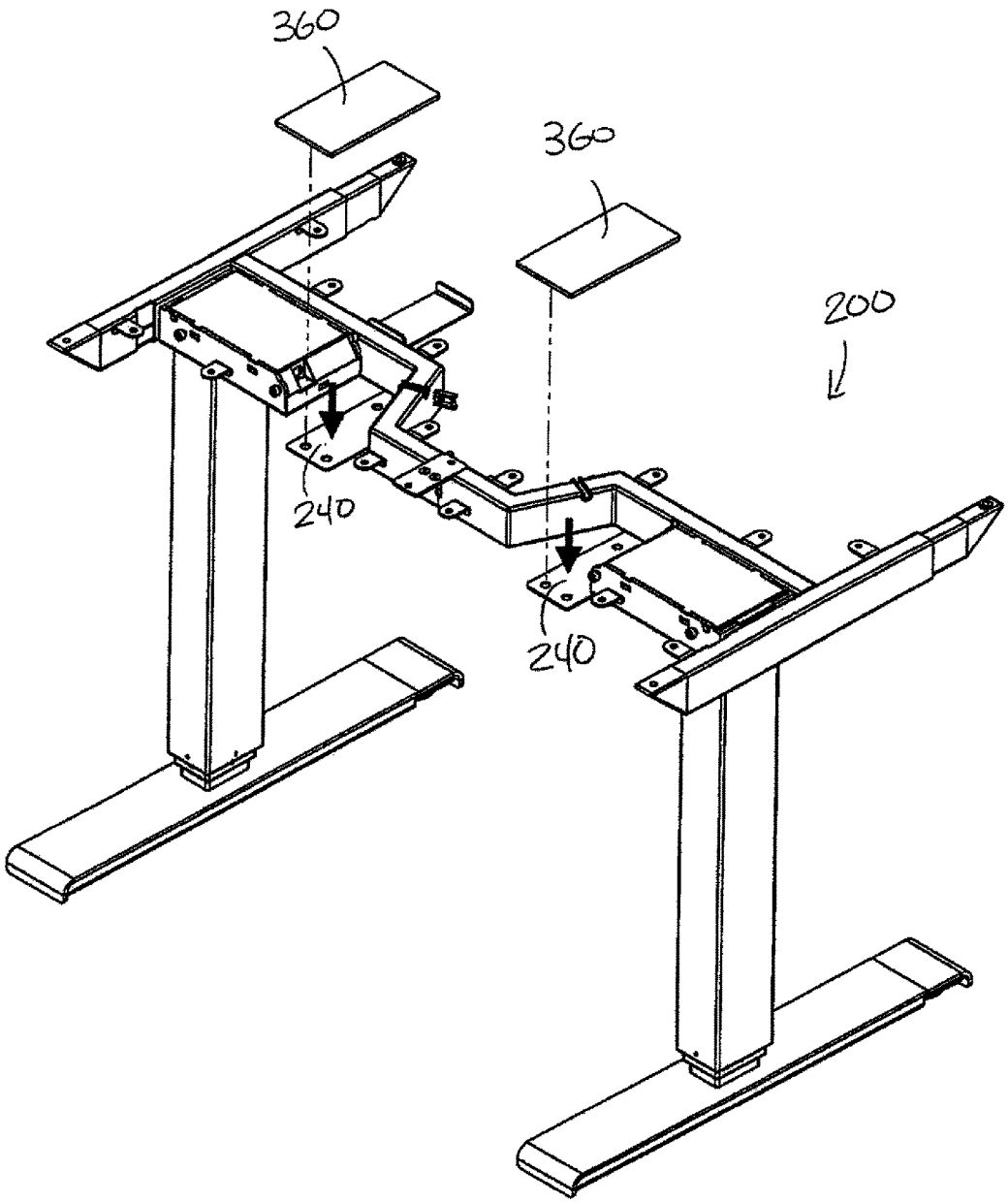
FIGS. 8A and 8B illustrate a perspective view of one embodiment of a support base of the present disclosure.
Figure 8B:
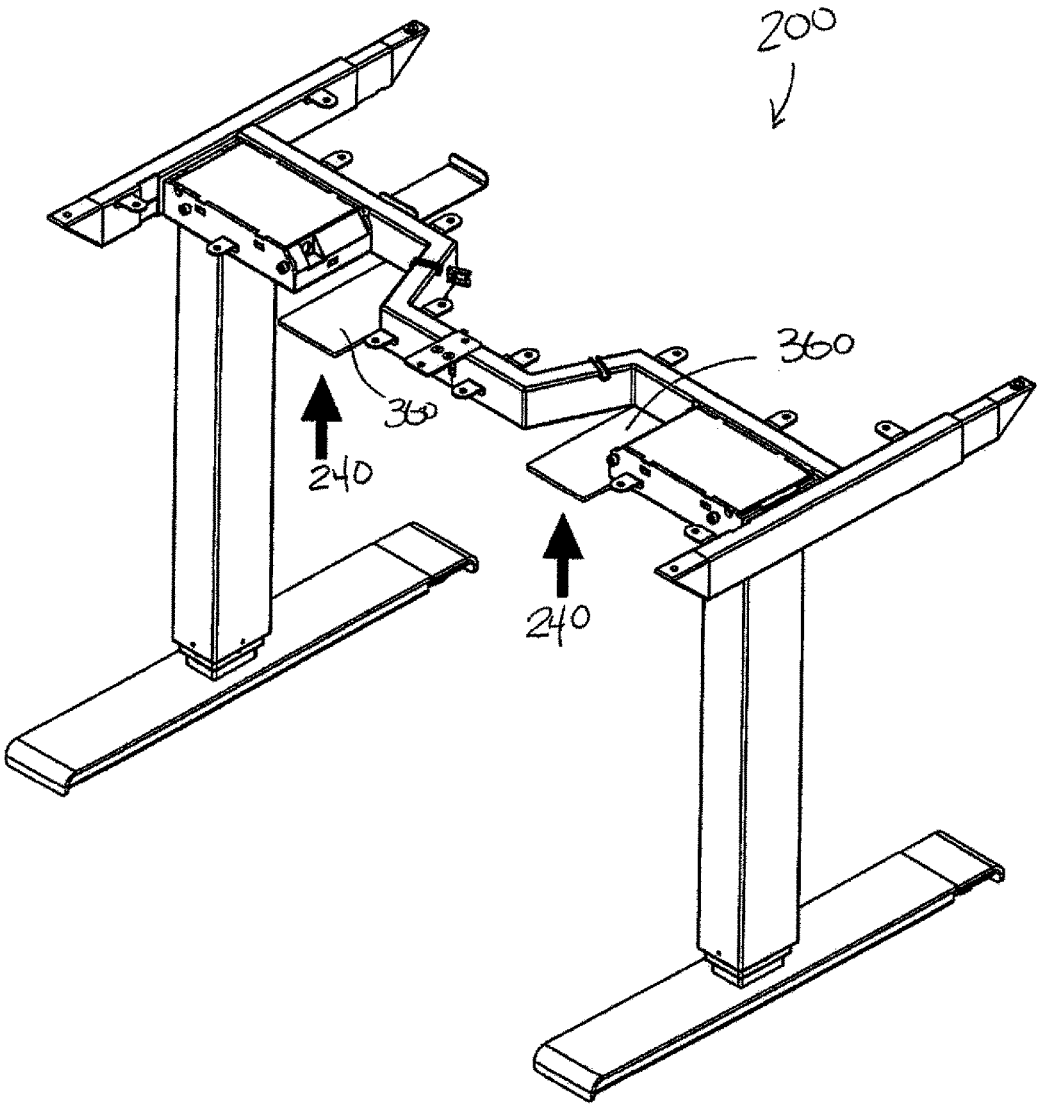

FIGS. 4A-6B illustrate one embodiment of a length-adjustable foot support 300 isolated from the support base 200 for purposes of describing the various features of the foot support 300, wherein FIGS. 4A-4B illustrate a perspective view taken from the top and underside respectively of a length-adjustable foot support 300 in a non-extended, assembled condition, FIGS. 5A-5B illustrate an exploded view taken from the top and underside respectively of a length-adjustable foot support 300 in an extended condition, and FIGS. 6A-6B illustrate a perspective view taken from the top and underside respectively of a length-adjustable foot support 300 in an extended and assembled condition. The length-adjustable foot support 300 further comprises a housing 330 and an extension member 340 that is movable relative to the housing 330 from a first position defining a first, shortest length (FIGS. 4A-4B) of the at least one length-adjustable foot support 300, to a second, extended position (FIGS. 5A-6B) defining a second length of the at least one length-adjustable foot support 300 that is longer than the first, shortest length. In a preferred embodiment, the extension member 340 is telescopically and slidably received within the housing 330. The extension member 340 further comprises an end cap 350 that abuts the housing 330 as shown in FIGS. 4A-4B when the extension member 340 is in a non-extended position relative to the housing 330. When the length-adjustable foot support 300 is in an extended position, the end cap 350 is spaced from the housing 330 as shown in FIGS. 5A-6B, and in a preferred embodiment a spacer 360 is disposed between the end cap 350 and the housing 330 when the extension member 340 is in an extended position to prevent the extension member 340 from extending back into the housing 330 and to fix the length of the at least one length-adjustable foot support 330. The length of the length-adjustable foot support 300 may be varied by varying the size of the spacer 360, it being understood that a variety of different sizes of spacers 360*a*-360*c* may be used between the end cap 350 and housing 330 as shown in FIGS. 7A-7B in order to vary the length of the at least one length-adjustable foot support 300. FIGS. 8A-8B illustrate a spacer storage location 240 associated with the support base 200 for storing spacers 360 when not attached to the length-adjustable foot supports 300, it being understood that spacers 360 may be stored anywhere on or separate from the support base 200.

The underside views of the embodiment of FIGS. 4B-7B illustrate fastener openings 332 along the housing 330 and fastener openings 342 along the extension member 340 that align to receive one or more fasteners 370 for securing the extension member 340 to the housing 330. When the extension member 340 is fully retracted into the housing 330 such that the length-adjustable foot support 300 is in a non-extended position (FIGS. 4A-4B), fasteners 370 may be attached through mating openings 332, 342 in the housing 330 and extension member 340 respectively to secure the extension member 340 relative to the housing 330. When it is desired to expand the length of the length-adjustable foot support 300, the fasteners 370 may be removed, the extension member 340 may be extended out from the housing 330 until additional fastener openings 342 along the housing extension member 340 align with the fastener openings 332 along the housing 330 to receive fasteners 370 for securing the extension member 340 to the housing 330. Additionally, as shown in FIGS. 5A-6B, spacer 360 may be located between the end cap 350 and the housing 330 even when the extension member 340 and housing 330 are connected through the use of fasteners 370. Spacer 360 may be attached to extension member 340 through the use of pins 362 (FIGS. 5B and 7B) that engage with mating openings 342 in the extension member 340. While the use of pins 362 is shown, it will be understood that other fastening methods are possible.

While it is preferable to use fasteners 370 to secure the extension member 340 to the housing 330, the use of fasteners 370 may not always be possible or desired, in which case a spacer 360 may be used without fasteners 370 to maintain a particular spacing between the extension member 340 and housing 330. For example, it may be desired to use a spacer 360 of a particular size to create a particular support base and/or table footprint that results in the non-alignment of fastener openings 332 in the housing 330 with the fastener openings 342 in the extension member 340, in which case it would not be possible to use fasteners 370 and it would only be possible to use the spacer 360. In one embodiment (not shown), the extension member 340 may be spring-biased in the direction of the housing 330 such that the extension member 340, upon being pulled out from the housing 330, would automatically return toward the housing 330 unless a spacer 360 is positioned between the end cap 350 and housing 330 to function as a barrier preventing the extension member 340 from withdrawing back toward the housing 330.

Figure 9:
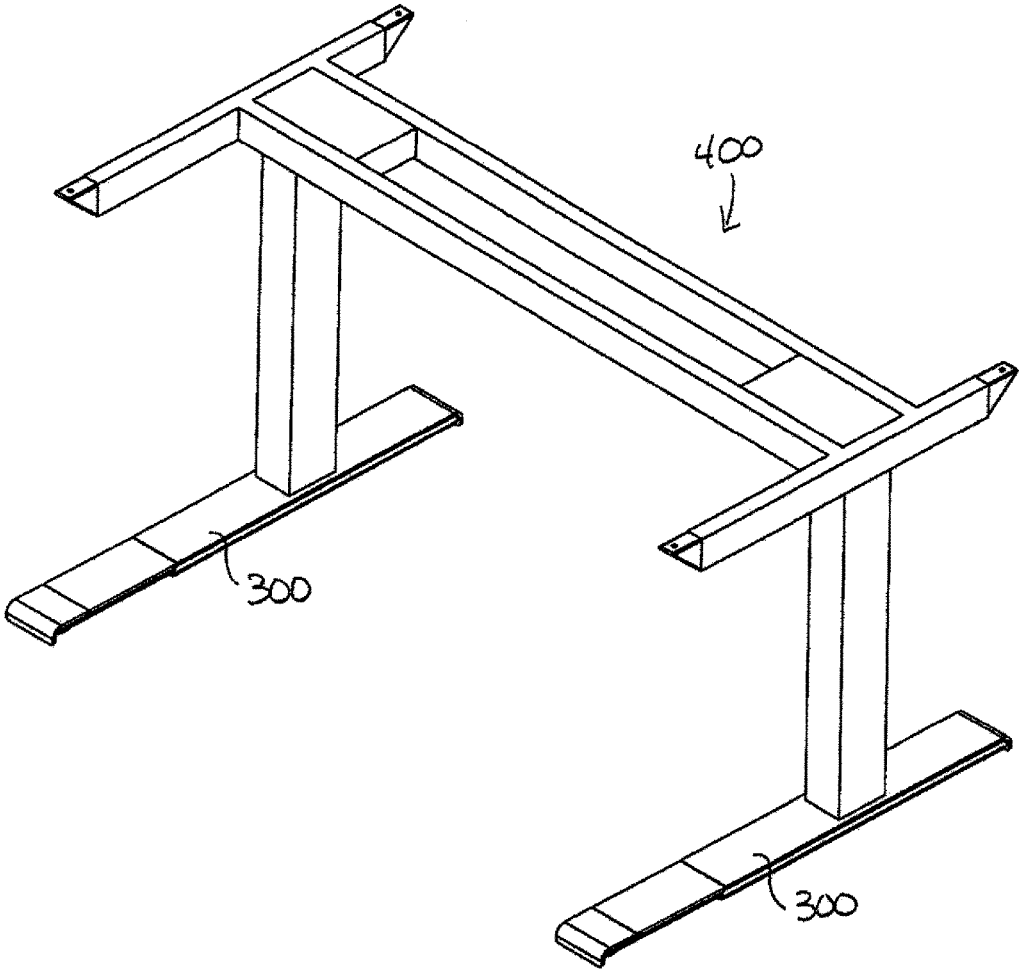
FIG. 9 is a perspective view of one embodiment of a table of the present disclosure.

The length-adjustable foot support 300 illustrated in the various embodiments described herein may be used with a non-adjustable table 400 (shown without a work surface) as shown in FIG. 9, if it is desired to vary the length of the foot support 300 in response to a varying load (not shown) on the table 400. For example, if it is necessary to place a large load near an edge of the table 400, it might be desired to have an extended footprint support, in which case it may be beneficial to extend the length of the length-adjustable foot support as much as possible.

Figure 10:
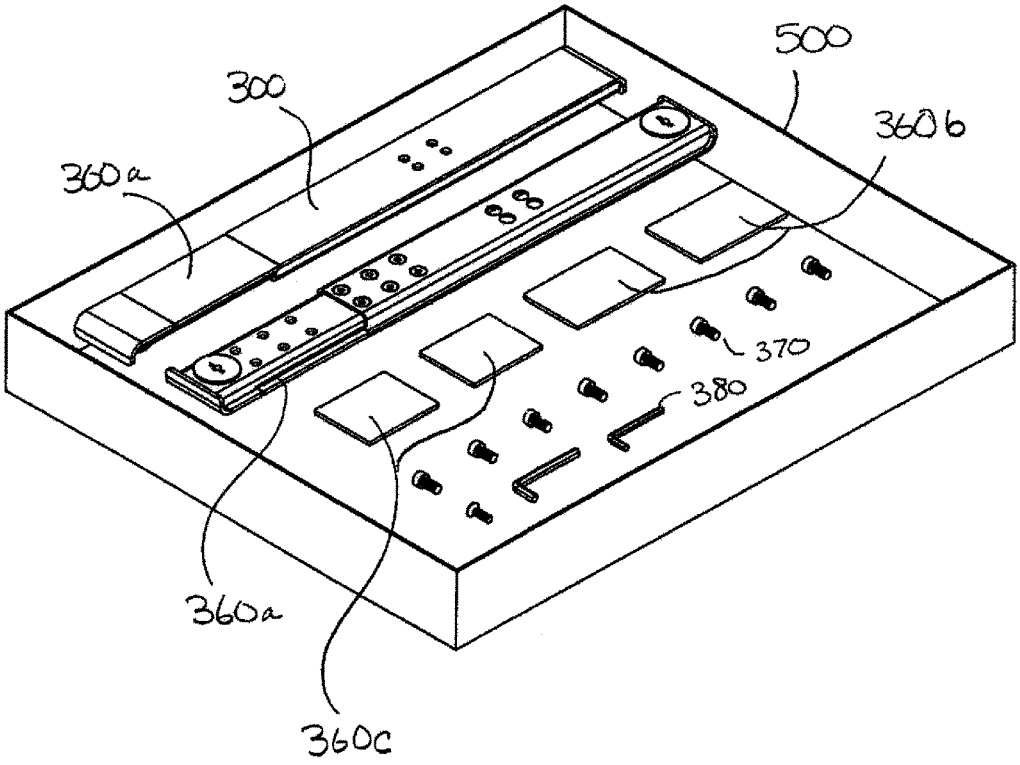
FIG. 10 is one embodiment of a kit incorporating one embodiment of a length-adjustable foot support of the present disclosure.

The length-adjustable foot support 300 illustrated in the various embodiments described herein may also be provided as a standalone kit 500 as shown in the embodiment of FIG. 10, which may include one or more length-adjustable foot supports 300, one or more spacers of differing sizes 360*a*-360*c*, and fasteners 370 and assembly tool 380 if desired. Such a kit 500 may be used to retrofit an existing table (not shown) not currently provided with length-adjustable foot supports, but where it is desired to use length-adjustable foot supports.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A support base for supporting a work surface having a width and a depth, comprising:

(a) a width-adjustable support having a first end and a second end for supporting the width of the work surface;

(b) at least one depth-adjustable support disposed on either the first end or the second end of the width-adjustable support for supporting the depth of the work surface;

(c) a pair of height-adjustable supports, each having an upper end and a lower end for adjusting the height of the support base along a vertical axis; and (d) at least one length-adjustable foot support extending along a longitudinal axis that is transverse to the vertical axis and that is attached to the lower end of the at least one height-adjustable support, wherein the length of the at least one length-adjustable foot support is variable along the longitudinal axis, wherein the height-adjustable support extends upwardly from the length-adjustable foot support from a location mid-way along the length of the length-adjustable foot, wherein the height-adjustable support connects to the depth-adjustable support at a location mid-way along the length of the depth-adjustable support, and wherein the depth-adjustable support is positioned directly above the length-adjustable foot.

2. A support base for supporting a work surface having a width and a depth, comprising:

(a) a width-adjustable support having a first end and a second end for supporting the width of the work surface;

(b) at least one depth-adjustable support disposed on either the first end or the second end of the width-adjustable support for supporting the depth of the work surface;

(c) at least one height-adjustable support having an upper end and a lower end for adjusting the height of the support base along a vertical axis; and (d) at least one length-adjustable foot support extending along a longitudinal axis that is transverse to the vertical axis and that is attached to the lower end of the at least one height-adjustable support, wherein the length of the at least one length-adjustable foot support is variable along the longitudinal axis, wherein the at least one length-adjustable foot support further comprises a housing and an extension member that is movable relative to the housing from a first position defining a first, shortest length of the at least one length-adjustable foot support, to a second position defining a second length of the at least one length-adjustable foot support that is longer than the first, shortest length, wherein the extension member further comprising an end cap, and wherein the end cap abuts the housing when the extension member is in the first position, and wherein the end cap is spaced from the housing when the extension member is in the second position; and a spacer disposed between the end cap and the housing when the extension member is in the second position to prevent the extension member from extending back into the housing and to fix the length of the at least one length-adjustable foot support; and wherein the spacer comprises individual spacers of various lengths in order to vary the length of the at least one length-adjustable foot support.

3. The support base of claim 1 or claim 2, further comprising:

(e) a work surface mounted onto the width-adjustable support and the at least one depth-adjustable support.

4. The support base of claim 1 or claim 2, wherein the at least one depth-adjustable support comprises a pair of depth-adjustable supports, one disposed on each of the first and second ends of the width-adjustable support.

5. The support base of claim 1 or claim 2, wherein the at least one height-adjustable support comprises a first height-adjustable support disposed adjacent to the first end of the width-adjustable support and a second height-adjustable support disposed adjacent to the second end of the width-adjustable support.

6. The support base of claim 5, wherein the at least one length-adjustable foot support comprises a first length-adjustable foot support attached to the lower end of the first height-adjustable support and a second length-adjustable foot support attached to the lower end of the second height-adjustable support.

7. The support base of claim 1, wherein the at least one length-adjustable foot support further comprises a housing and an extension member that is movable relative to the housing from a first position defining a first, shortest length of the at least one length-adjustable foot support, to a second position defining a second length of the at least one length-adjustable foot support that is longer than the first, shortest length.

8. The support base of claim 7, wherein the extension member further comprising an end cap, and wherein the end cap abuts the housing when the extension member is in the first position.

9. The support base of claim 8, wherein the end cap is spaced from the housing when the extension member is in the second position.

10. The support base of claim 9, further comprising a spacer disposed between the end cap and the housing when the extension member is in the second position to prevent the extension member from extending back into the housing and to fix the length of the at least one length-adjustable foot support.

11. The support base of claim 7, wherein the extension member is telescopically received within the housing.

12. The support base of claim 11, further comprising one or more fasteners for securing the extension member to the housing.

* * * * *